US007803276B2

(12) United States Patent
Minhas et al.

(10) Patent No.: US 7,803,276 B2
(45) Date of Patent: Sep. 28, 2010

(54) REGENERATION OF SULFURIC ACID

(75) Inventors: Bhupender S. Minhas, Bridgewater, NJ (US); Dennis G. Peiffer, Annandale, NJ (US); Jeffrey S. Beck, Annandale, NJ (US); David L. Stern, Asbury, NJ (US); Tomas R. Melli, Haymarket, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 480 days.

(21) Appl. No.: 10/579,175

(22) PCT Filed: Dec. 1, 2004

(86) PCT No.: PCT/US2004/040087

§ 371 (c)(1),
(2), (4) Date: Jun. 17, 2008

(87) PCT Pub. No.: WO2005/056727

PCT Pub. Date: Jun. 23, 2005

(65) Prior Publication Data

US 2008/0237129 A1 Oct. 2, 2008

Related U.S. Application Data

(60) Provisional application No. 60/527,210, filed on Dec. 5, 2003.

(51) Int. Cl.

| | |
|---|---|
| ***C10G 17/00*** | (2006.01) |
| ***C10G 17/06*** | (2006.01) |
| ***B01D 61/00*** | (2006.01) |
| *B01D 61/08* | (2006.01) |

(52) U.S. Cl. ..... 210/651; 210/650; 210/652; 208/254 R

(58) Field of Classification Search ..... None
See application file for complete search history.

(56) References Cited

U.S. PATENT DOCUMENTS

| | | | | |
|---|---|---|---|---|
| 2,276,210 | A * | 3/1942 | Lane et al. | 210/641 |
| 4,159,940 | A * | 7/1979 | Smith | 208/254 H |
| 4,493,762 | A * | 1/1985 | Rudnick | 208/400 |
| 4,605,489 | A * | 8/1986 | Madgavkar | 208/87 |
| 4,960,507 | A | 10/1990 | Evans et al. | |
| 5,770,047 | A * | 6/1998 | Salazar et al. | 208/254 R |
| 6,096,195 | A * | 8/2000 | Streicher et al. | 208/254 R |
| 6,183,648 | B1 * | 2/2001 | Kozak et al. | 210/651 |
| 2005/0131084 | A1 * | 6/2005 | Kohler et al. | 518/726 |
| 2005/0139555 | A1 * | 6/2005 | Dancuart Kohler et al. | 210/767 |

FOREIGN PATENT DOCUMENTS

| | | |
|---|---|---|
| EP | 0 143 129 | 6/1985 |
| EP | 0 376 637 | 7/1990 |

* cited by examiner

*Primary Examiner*—Krishnan S Menon
(74) *Attorney, Agent, or Firm*—Gerard J. Hughes; Bruce M Bordelon

(57) ABSTRACT

This invention relates to a process for recycling acid used to remove nitrogen contaminants from hydrocarbons using polymeric membranes to separate spent acid from the acid extraction of hydrocarbons into acid for recycle and acid for regeneration.

14 Claims, 6 Drawing Sheets

REGENERATION OF SULFURIC ACID

This application is the U.S. National Phase filing of PCT Application No. PCT/US2004/040087 filed Dec. 1, 2004, which claims priority to U.S. Provisional Patent Application No. 60/527,210 filed Dec. 5, 2003.

FIELD OF THE INVENTION

This invention relates to a process for recycling acid used to remove nitrogen contaminants from hydrocarbons. More particularly, polymeric membranes are used to separate spent acid from the acid extraction of hydrocarbons into acid for recycle and acid for regeneration.

BACKGROUND OF THE INVENTION

Spent sulfuric acid is generated in several petroleum processes including alkylation of olefinic hydrocarbons with isoparaffins and nitration of aromatics. The production of motor alkylate is still a major process in many refineries. Without regard to the particular petroleum process that is the source of spent sulfuric acid, such spent acid will typically result in dilution of acid due to the formation of acid soluble oils.

The recovery of sulfuric acid from such acid soluble oils is an economic factor for the recycling of spent acid. Spent acids can be recovered by methods such as combustion, distillation, evaporation, stripping spent acid with a stripping gas, or extraction but they are not efficient due to the strong interaction between the acid and oil. More recent methods have used hydrogenation of acid soluble oils to recover spend acid.

Because of the expense involved in on-site regeneration of spent sulfuric acid, many refiners send spent acid off-site for acid recovery. However, this entails significant handling and transportation costs which adds to the cost of spent acid regeneration.

There is a need for a cost-effective means of integrating sulfuric acid recovery into petroleum processes which involve acid treatment of hydrocarbons.

SUMMARY OF THE INVENTION

The present invention relates to a process for the acid extraction of a hydrocarbon feed containing nitrogen contaminants which comprises: contacting the hydrocarbon feed with a mineral acid in an extraction zone to produce an acid treated hydrocarbon mixture, conducting the acid treated hydrocarbon mixture to a separation zone and separating the acid treated hydrocarbon mixture into a nitrogen lean hydrocarbon and a nitrogen rich hydrocarbon/acid mixture, conducting the nitrogen rich hydrocarbon/acid mixture to a first compartment of a membrane-containing unit, said unit further comprising a membrane and a second compartment, and selectively permeating the nitrogen rich hydrocarbon/acid mixture through the membrane into a hydrocarbon lean acid permeate in the second compartment and a hydrocarbon rich acid retentate in the first compartment.

Another embodiment relates to a process for the acid extraction of a hydrocarbon feed containing nitrogen contaminants which comprises: contacting the hydrocarbon feed with a mineral acid in an extraction zone to produce an acid treated hydrocarbon mixture, conducting the acid treated hydrocarbon mixture to a separation zone and separating the acid treated hydrocarbon mixture into a nitrogen lean hydrocarbon and a nitrogen rich hydrocarbon/acid mixture, conducting the nitrogen rich hydrocarbon/acid mixture to a first compartment of a membrane-containing unit, said unit further comprising a membrane and a second compartment, selectively permeating the nitrogen rich hydrocarbon/acid mixture through the membrane into a hydrocarbon lean acid permeate in the second compartment and a hydrocarbon rich acid retentate in the first compartment, and passing the hydrocarbon rich acid retentate to the separation zone.

Yet another embodiment relates to a process for the acid extraction of a hydrocarbon feed containing nitrogen contaminants which comprises: contacting the hydrocarbon feed with a mineral acid in an extraction zone to produce an acid treated hydrocarbon mixture, conducting the acid treated hydrocarbon mixture to a separation zone and separating the acid treated hydrocarbon mixture into a nitrogen lean hydrocarbon and a nitrogen rich hydrocarbon/acid mixture, conducting the nitrogen rich hydrocarbon/acid mixture to a first compartment of a membrane-containing unit, said unit further comprising a membrane and a second compartment, selectively permeating the nitrogen rich hydrocarbon/acid mixture through the membrane into a hydrocarbon lean acid permeate in the second compartment and a hydrocarbon rich acid retentate in the first compartment, and passing the hydrocarbon lean acid permeate to the extraction zone.

A further embodiment relates to a process for the acid extraction of a hydrocarbon feed containing nitrogen contaminants which comprises: contacting the hydrocarbon feed with a mineral acid in an extraction zone to produce an acid treated hydrocarbon mixture, conducting the acid treated hydrocarbon mixture to a separation zone and separating the acid treated hydrocarbon mixture into a nitrogen lean hydrocarbon and a nitrogen rich hydrocarbon/acid mixture, conducting the nitrogen rich hydrocarbon/acid mixture to a first compartment of a first membrane-containing unit, said unit further comprising a membrane and a second compartment, selectively permeating the nitrogen rich hydrocarbon/acid mixture through the membrane into a hydrocarbon lean acid permeate in the second compartment and a hydrocarbon rich acid retentate in the first compartment, passing the hydrocarbon lean acid permeate to a first compartment of a second membrane-containing unit, said second unit further comprising a membrane and a second compartment and selectively permeating the hydrocarbon lean acid permeate to obtain a second hydrocarbon rich acid retentate and a second hydrocarbon lean acid permeate.

DETAILED DESCRIPTION OF THE INVENTION

Figure 1:
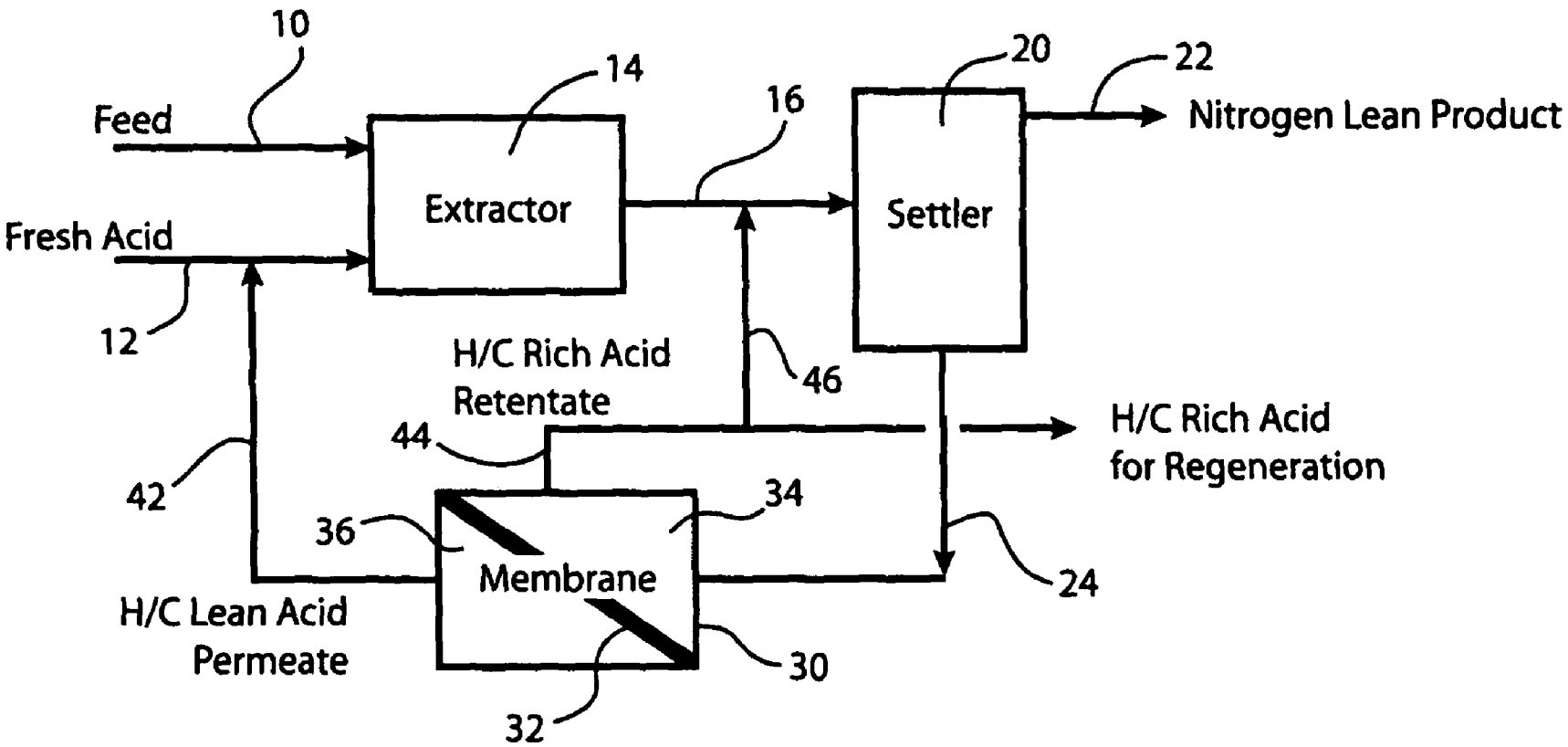
FIG. 1 is a process flow diagram illustrating the membrane separation process.

The hydrocarbon feeds containing nitrogen contaminants are any hydrocarbon feeds that are acid extracted in the course of petroleum processing. Nitrogen contaminants in the form of nitrogen heterocyclic compounds act as competitive inhibitors to a wide range of catalytic petroleum upgrading processes such as catalytic hydroprocessing. Nitrogen compounds are present in typical petroleum feedstocks in the range of 10 to 3000 wppm, based on feed.

In one embodiment, the feed to the present process is a diesel fuel or diesel fuel precursor. By diesel fuel is meant a hydrocarbon boiling in the 204 to 371° C. (400 to 700° F.) range. The diesel fuel may be untreated or may be previously treated to partially remove heteroatom species or aromatics.

In another embodiment, the feedstock may be a cat naphtha such as an olefinic naphtha from one or more olefinic naphtha boiling range refinery streams that typically boil in the range of about 50° F. to about 450° F. The term "olefinic naphtha stream" as used herein is those streams having an olefin content of at least about 5 wt. %, based on naphtha. Non-limiting examples of olefinic naphtha streams includes fluid catalytic cracking unit naphtha ("FCC naphtha"), steam cracked naphtha, and coker naphtha. Also included are blends of olefinic naphthas with non-olefinic naphthas as long as the blend has an olefin content of at least about 5 wt. %.

Olefinic naphtha refinery streams generally contain not only paraffins, naphthenes, and aromatics, but also unsaturates, such as open-chain and cyclic olefins, dienes, and cyclic hydrocarbons with olefinic side chains. The olefinic naphtha feedstock typically also contains an overall olefins concentration ranging as high as about 60 wt. %, based on feedstock, more typically as high as about 50 wt. %, and most typically from about 5 wt. % to about 40 wt. %. The olefinic naphtha feedstock can also have a diene concentration up to about 15 wt. %, but more typically less than about 5 wt. % based on the total weight of the feedstock. High diene concentrations are undesirable since they can result in a gasoline product having poor stability and color. The sulfur content of the olefinic naphtha will generally range from about 300 wppm to about 7000 wppm, based on naphtha, more typically from about 1000 wppm to about 6000 wppm, and most typically from about 1500 to about 5000 wppm. The sulfur will typically be present as organosulfur, i.e., organically bound sulfur present as sulfur compounds such as simple aliphatic, naphthenic, and aromatic mercaptans, sulfides, di- and polysulfides and the like. Other organosulfur compounds include the class of heterocyclic sulfur compounds such as thiophene and its higher homologs and analogs. Nitrogen will also be present and will usually range from about 5 wppm to about 500 wppm.

The feedstock may also be an alkylate derived from an alkylation process wherein an olefin is contacted with an isoparaffin in the presence of a catalyst, typically an acid catalyst. The product (an alkylate) is normally used as a blend component in the production of motor gasoline.

The feedstock used in the process of the invention may also be feeds that boil in the lubricating oil range, typically having a 10% distillation point greater than 650° F. (343° C.), measured by ASTM D 86 or ASTM 2887, and are derived from mineral or synthetic sources. The feedstock may have a very low wax content, such as a dewaxed oil and can range up to 100 wt. % wax. The wax content of a feed may be determined by nuclear magnetic resonance spectroscopy (ASTM D5292). The feeds may be derived from a number of sources such as oils derived from solvent refining processes such as raffinates, partially solvent dewaxed oils, deasphalted oils, distillates, vacuum gas oils, coker gas oils, slack waxes, foots oils and the like, and Fischer-Tropsch waxes.

The hydrocarbon feed is contacted with a mineral acid in an extraction zone. The acid may be fresh acid or may be acid that has been recycled. The acid is a mineral acid, preferably a strong mineral acid, most preferably sulfuric acid. For sulfuric acid, the acid concentration is preferably 80-98 wt. %, more preferably 85-91 wt. %, based on acid. For other mineral acids, the acid strength will be the most concentrated acid that is commercially available. The concentrated acid may be diluted depending on the feed to be extracted. The contacting method can be dispersive or nondispersive. The nondispersive method is preferred to facilitate separation of acid phase from the hydrocarbon feed phase. A preferred nondispersive contacting method is a fiber film contactor. Fiber film contactors are described in U.S. Pat. No. 5,705,074 which is incorporated herein by reference.

The acid treated hydrocarbon mixture from the extraction zone is the conducted to a separation zone to achieve at least a partial separation of acid and organic phases. The separation zone is preferably a settler. Settlers are phase separation devices and are known in the art. Settlers may include coalescing media. Coalescing media include physical devices or chemical agents as aids to phase separation. Physical devices are preferred. The hydrocarbon (organic) phase is separated and may be further processed according to the needs of the finished product, e.g., neutralization of any remaining acid in the product, drying, clay treating to remove color species or some combination thereof. The acid phase from the separation zone may be recycled back to the acid that is fed to the extraction zone or is preferably sent to the membrane-containing unit. The acid phase typically contains acid soluble oils (ASO) which are soluble in this phase. The total hydrocarbon content of the acid phase may range from 5 to 50 wt. %, based on acid phase.

The membrane-containing unit comprises an acid resistant housing containing a membrane separating a first compartment from a second compartment, or may be two or more membrane-containing units. The membranes are selectively permeable to the acids in the acid phase. The acid phase enters the first compartment and is separated (permeated) into an acid rich permeate lean in hydrocarbons in the second compartment and a hydrocarbon rich retentate lean in acid in the first compartment. By hydrocarbon rich is meant that the retentate contains more hydrocarbon than the feed to the membrane-containing unit. By acid rich permeate is meant that the permeate contains more acid and water than the feed to the membrane-containing unit. The permeate may then be recycled back to the acid feed to the extraction zone or sent to a second membrane-containing unit containing a membrane selectively permeable to acid and water. The acid from the second unit may be sent to recycle. As noted previously, the permeate may contain some ASO associated with the acid phase.

The hydrocarbon rich retentate may be recycled to the separation zone with an acid slip stream sent for regeneration or may be sent for further processing such as acid regeneration.

The membrane-containing units include a membrane housing and at least one membrane and are preferably operated at conditions sufficient to maximize the flow rate across the membrane. As is known in the art, the flow rate across the membrane is a function of operating conditions such as temperature and pressure as well as membrane properties such as membrane thickness, material of construction, membrane pore size and membrane pore geometry. The shape of the membrane housing of the membrane-containing unit may also impact flow rate across the membrane.

The membrane-containing units may preferably be operated at or near ambient temperatures although temperatures above or below ambient may be employed.

High flux or flow across the membrane can be achieved by operating with the thinnest membrane that will maintain its physical integrity under the operating conditions. To help the membrane maintain its physical integrity, a composite membrane may be used. For example, a thin selective polymeric layer (or membrane) may be supported on a non-selective, highly porous membrane, to produce a laminate structure. The selective membrane layer is preferably securely attached on top of the porous membrane material that constitutes a physical support. The thin polymeric layer may range in thickness from 0.1 micron to 50 microns.

The membranes used in the process of the present invention may be utilized in the form of hollow fibers, tubes, films, sheets, etc. The process may conveniently be carried out in a diffusion cell. The cell is divided into compartments by means of one or more membranes. The compartments each have means for removing the contents therefrom. The process may be carried out continuously or batchwise, but preferably in a continuous manner.

In one embodiment, the feed to a membrane-containing unit is maintained under conditions of pressure such that substantially all of the acid is in liquid phase. The permeate may be withdrawn in a vacuum, which is generally maintained in the range of 2 to 150 mm Hg. However, the permeate phase may also be withdrawn, i.e., as a vapor and subsequently condensed as in pervaporation. It is preferred to maintain the feed side under pressure without vacuum on the permeate side.

If a vacuum is employed, the vacuum on the permeate side of the membrane can affect both selectivity and flux, with higher vacuum leading generally to increases in flux, selectivity or both. Higher vacuum can be tolerated at higher temperatures, or with a lower boiling point acid. In yet another embodiment, a sweep gas may be passed across the membrane at a rate sufficient to increase the permeation rate. Suitable sweep gases include carbon dioxide, nitrogen, hydrogen, air, or low boiling hydrocarbons such as methane, ethane or propane.

Alternatively, the permeate side of the membrane may be swept by a liquid perstraction solvent in which the permeate is soluble and which is non-corrosive with respect to the membrane, at a rate sufficient to enhance the permeation rate of the permeable component or components through the membrane. Suitable perstraction solvents include higher molecular weight paraffins, organic acids, and compressed gases, e.g., ethane, propane, butane, etc. Especially suitable perstraction solvents are those which do not form azeotropic mixtures with any of the components of the waste acid mixture.

Typical process conditions according to the present invention depend on several variables including membrane separation method and feed composition. Determination of appropriate operating conditions is well within the capabilities of one skilled in the art. Some typical operating parameters for perstractive processes of the present invention which may be controlled according to the needs of the process include feed flow rates, absolute membrane flux, feed temperature, and pressure drop across the membrane.

With regard to materials of construction, suitable membranes for the present invention comprise perfluorinated ionomer membranes characterized by the presence of active anionic groups. The term "perfluorinated" refers to the replacement of hydrogen atoms in an organic compound by fluorine (except where the identity of a functional group would be altered thereby, such as in the case of per-fluoro-1-propanol). As used herein the term "perfluorinated ionomer membrane" refers to an ion-exchange membrane prepared from a perfluorinated ion-exchange polymer.

This class of ion exchange polymers is characterized by the presence of anionic groups attached to the polymer chains that are associated with protons and/or metal ions. The former exhibit acidic character while the latter show salt-like character. The anionic groups form a continuous or nearly continuous microphase within the polymer matrix. Examples of active anionic groups are carboxylate, sulfonate, and phosphonate.

The concentration of anionic groups can be expressed in units designated as EW (equivalent weight) which is defined as the mass in grams of the dry polymer in the acid form that would neutralize one equivalent of base. The EW of poly (acrylic acid) is 64, which is simply the molecular weight of the monomer acrylic acid. The EW of commercially available Nafion®, a perfluorinated copolymer manufactured by DuPont, usually ranges between 950 to 1,800. For more details about this membrane see W. Y. Hsu and T. C. Giercke, "Ion Transport and Clusters in Nafion® Perfluorinate Membranes," J. Membrane Science, 13 [1983], 307-326, which is incorporated herein by reference for all purposes to the extent that it is not inconsistent with the present invention.

Polymer properties depend on the type of polymer backbone, the ionic content, the type of ionic moiety (whether carboxylate, sulfonate, or phosphonate, etc.), the degree of neutralization and the type of cation (amine, metal, hydrogen, mono-valent, multi-valent). See Kirk-Othmer Encyclopedia of Technology (3rd Edition, Supplement Volume, pages 546-573).

A preferred membrane for use in the present process is identified in the trade as Nafion®, which is a copolymer of perfluoroethylene and perfluoro-vinylether, the latter component having pendant sulfonic or carboxylic acid groups. The structure of Nafion® is represented as follows, in the case of a sulfonated Nafion® in its acidic form:

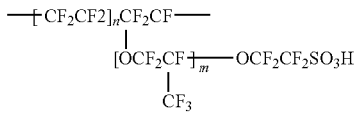

where m=5 to 13.5; and n=1,000;

Equivalent Weight (EW) Ranges 950-1,800

Cation Exchange Capacity 1.05-0.55 meq/m

Nafion® membranes are documented in the literature. See Hsu and Gierke, J. Membrane Science, 13 (1983), 307-326; S. C. Stenson, "Electrolytic Cell Membrane Development Surges," Chemical and Engineering News, Mar. 15, 1982; Y. Yamabe, "Perfluorinated Ionomer Membranes," Kirk-Othmer Encyclopedia of Chemical Technology (Supplement to 3rd Ed.), John Wiley & Sons, New York, N.Y. (1984); and T. D. Gierke, G. E. Munn and F. C. Wilson, "Morphology of Perfluorosulfonated Membrane Product," pages 195-216 in Perfluorinated Ionomer Membranes, edited by A. Eisenberg and H. L. Yaeger, ACS Symposium Series 180 (ACS, Washington, D.C. [1982]; S. J. Sondheimer et al, Rev. Macromol. Chem. Phys., C26(3), 353-413 (1986), all of which are incorporated herein by reference for all purposes to the extent that they are not inconsistent with the present invention.

Nafion® membranes can be symmetric or asymmetric. Asymmetric Nafion® membranes are comprised of material which is processed so as to produce two membrane sides having different properties such as, for example, a layer of carboxylic acid-containing resin in association with a layer of sulfonic acid-containing resin. More preferred Nafion® membranes are Nafion® 1100 and Nafion® 800 marketed by DuPont, Fluoropolymers, Wilmington, Del.

Other preferred polymeric membranes suitable for the present invention include membranes made of polyvinyl alcohol (PVA), polyvinyl sulfate (PVS), and other oxoanion modified PVA such as PVA phosphate, arsenate, selenate, tellurate, nitrate, borate and the like. When a PVA membrane is used, the hydroxyl groups of the PVA membrane react with sulfuric acid to form sulfate groups. Therefore, the membrane material becomes polyvinyl sulfate or a copolymer of vinyl sulfate and vinyl alcohol. The PVA membrane before use is preferably crosslinked using a diisocycanate such as 1,4-diisocyanatohexane. Preferably the membranes are made of crosslinked PVA, PVS and other oxoanion modified PVAs. Crosslinking enhances the mechanical and structural stability of the membrane and may also influence both selectivity and flux characteristics. Other suitable crosslinking agents include 1,4-diisocyanatobutane, 1,8-diisocyanatooctane, 1,12-diisocyanatododecane, 1,5-diisocyanato-2-methyl pentane, and 4,4'-diisocyanato-diphenylmethane. Membrane flexibility and resistance to sulfuric acid may be a function of the type of crosslinking agents being used. In addition to poly (vinyl sulfate), other possible membrane materials can be poly (vinyl phosphate) and/or other vinyl groups which may have affinity to sulfuric acid.

In addition to the formation of polyvinylsulfate (PVS) from the reaction of polyvinyl alcohol with sulfuric acid, other inorganic oxoanion modified polymer membranes may be used. They include polyvinyl phosphate membranes made from PVA membranes according to the following reaction:

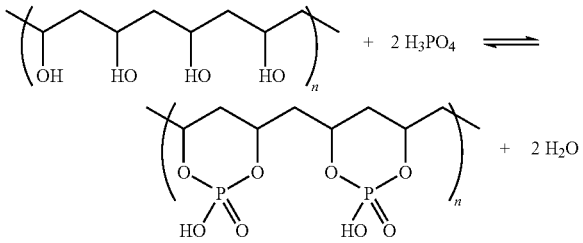

In addition to the phosphate, one can also use arsenate, antimonate, or bismuthate to form polyvinyl arsenate, polyvinyl antimonate, and polyvinyl bismuthate, respectively. Chalcogenic oxides, such as polyvinyl selenate and polyvinyl tellurate, formed from the reaction of selenic and telluric acids with PVA may also be used.

Another suitable membrane is formed by reacting PVA with boric acid, as shown below.

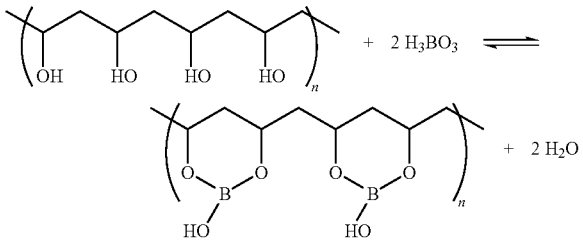

Beyond the formation of PVA or oxoanion modified PVA, one can also envision the use of other polymerized alcohols and their oxoanion modified compounds, referred herein as oxoanion modified polymerized alcohols. Examples of suitable polymerized alcohols include polypropyl alcohol, polybutyl alcohol, and the like. These structures also may include polymerized alcohol copolymers, polymerized terpolymers, oxoanion modified polymerized alcohol copolymers, oxoanion modified polymerized alcohol terpolymers and the like. These too would form the corresponding modified polymers.

The feed to the membrane-containing unit is processed by the membrane into a hydrocarbon lean acid permeate and a hydrocarbon rich acid retentate. The hydrocarbon lean acid permeate is then recycled to the fresh acid feed to the extraction zone. The hydrocarbon rich acid retentate may then be recycled to the separation zone or may be treated to separate hydrocarbon and spent acid.

Figure 2:
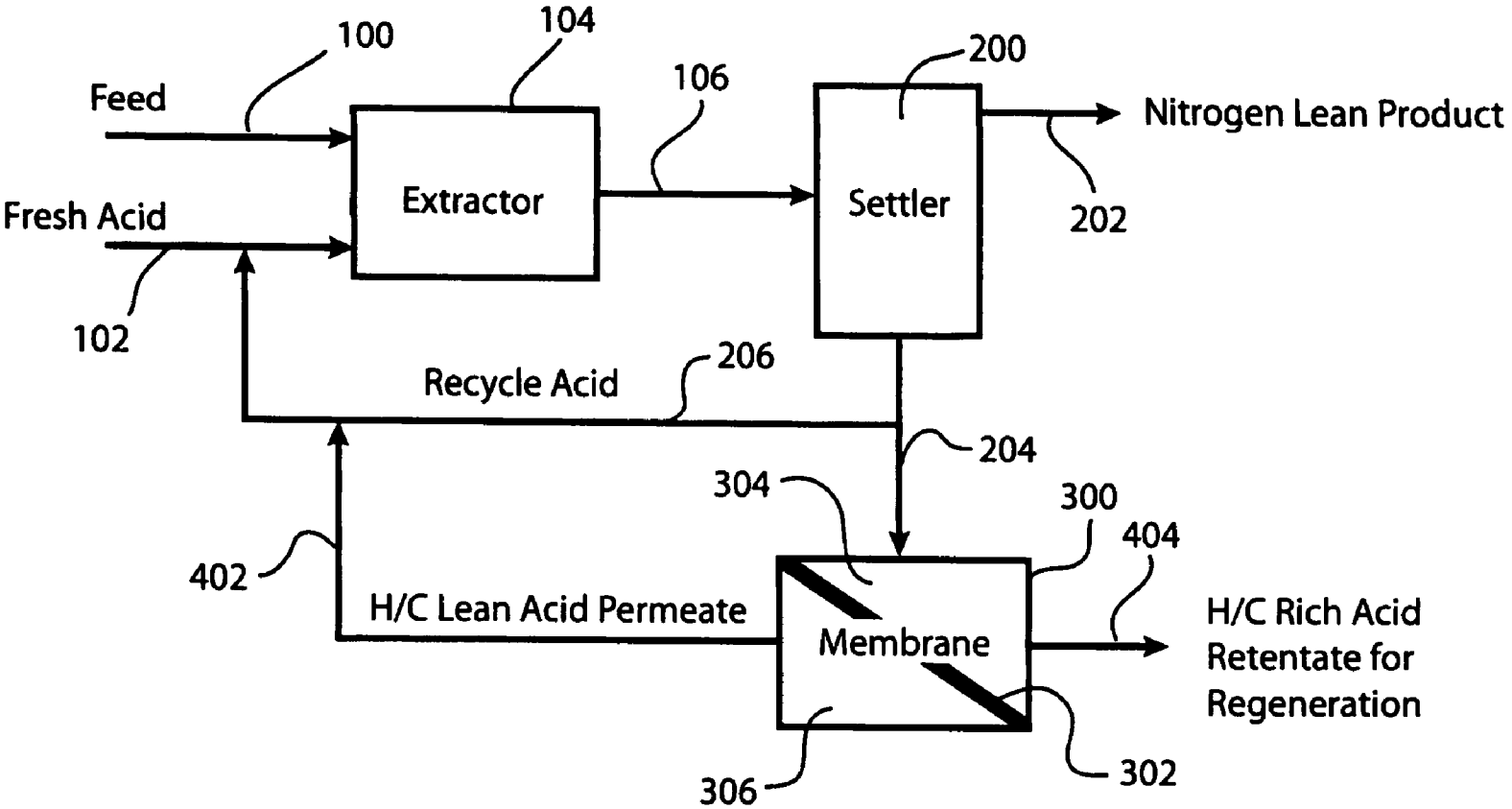
FIG. 2 is a process flow diagram illustrating an alternative membrane separation process.

The process of the invention is further exemplified according to FIGS. 1 and 2. In FIG. 1, hydrocarbon feed in line 10 and fresh acid in line 12 are combined in extractor 14. The hydrocarbon/acid mixture is then conducted from extractor 14 through line 16 to separation zone 20. In separation zone 20, the hydrocarbon/acid mixture is separated into nitrogen lean hydrocarbon product that is removed through line 22. Spent aqueous acid containing ASO is removed through line 24 and conducted to membrane containing unit 30. The spent acid is contacted with membrane 32 to form a hydrocarbon (ASO) rich acid retentate in compartment 34 and a hydrocarbon lean acid permeate in compartment 36. The hydrocarbon lean acid permeate is conducted through line 42 where it is recycled as acid feed to extractor 14. Hydrocarbon rich acid retentate is removed from 34 through line 44. The hydrocarbon rich retentate in line 44 or at least a portion thereof can be recycled to settler 20 through line 46. In the alternative, hydrocarbon rich retentate in line 44 or at least a portion thereof may be sent to acid regeneration.

Another embodiment of the present process is shown in FIG. 2. In FIG. 2, hydrocarbon feed in line 100 and fresh acid in line 102 are combined in extractor 104. The hydrocarbon/acid mixture is then conducted from extractor 104 through line 106 to separation zone 200. In separation zone 200, the hydrocarbon/acid mixture is separated into nitrogen lean hydrocarbon product that is removed through line 202. Spent aqueous acid containing ASO is removed through line 204 and conducted to membrane containing unit 300. At least a portion of the spent acid in line 204 may be recycled to fresh acid feed in line 102 through line 206. The spent acid is contacted with membrane 302 to form a hydrocarbon (ASO) rich acid retentate in compartment 304 and a hydrocarbon lean acid permeate in compartment 306. Hydrocarbon lean acid permeate is sent to extractor 104 through line 402. Hydrocarbon rich retentate in line 404 may be sent to acid regeneration.

The following non-limiting example serves to illustrate the invention.

EXAMPLE 1

A poly (vinyl alcohol) [PVA] membrane is formed using the following method. PVA polymer was dissolved in 50/50 solution of dimethylsulfoxide (DMSO) and dimethylformamide (DMF). This solution is mixed with a solution of hexamethyldiisocyanate in 50/50 solution of DMSO and DMF. A thin layer of this combined solution is coated on top of a 0.2 micron Gore-Tex substrate using a casting knife. The coated material is next crosslinked at room temperature and than at 130° C. for 5 hours.

Figure 3:
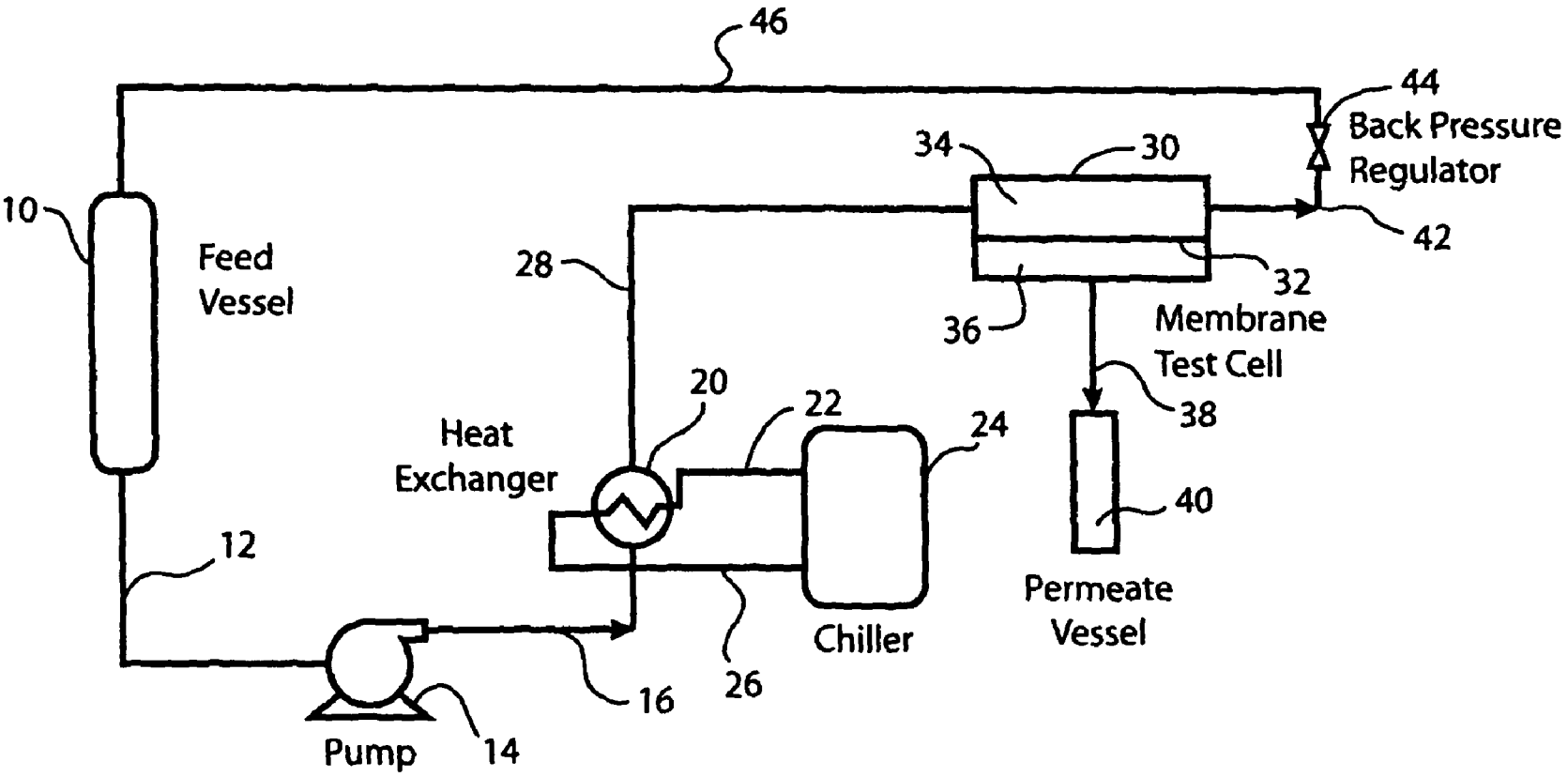
FIG. 3 is a process flow diagram illustrating the continuous membrane test system.

The crosslinked PVA membrane was used for evaluating sulfuric acid regeneration from alkylation spent acid, which contains water and acid soluble oil (ASO) in addition to acid. Membrane performance evaluation was accomplished using the procedure and equipment shown in FIG. 3. The spent alkylation acid is conducted from feed vessel 10 through line 12 to pump 14. Pressurized spent acid is conducted from pump 14 through line 16 to heat exchanger 20. Heat exchanger 20 is connected in a loop to chiller 24 through lines 22 and 26 to achieve temperature control. Spent acid from heat exchanger 20 is then conducted through line 28 to membrane test cell 30 containing membrane 32 and compartments 34 and 36. Permeate that collects in compartment 36 is collected through line 38 in permeate test cell 40. Retentate from compartment 34 is recycled through line 42, back pressure regulator 44 and line 46 to feed vessel 10. The test parameters are as follows: Feed vessel—3000 ml; pump rate—up to 1 gal/min (0.063 l/sec) with a 0.63 gal/min (0.040 l/sec) normal operating rate; heat exchanger—1.5" (3.91 cm) diameter and 18.75" (47.6 cm) length with a 2.18 $ft^2$ (2025 $cm^2$) surface area; effective membrane surface area in use—24 $in^2$ (155 $cm^2$) ; and maximum operating pressure of test cell—1000 psig (6996 kPa).

Figure 4:
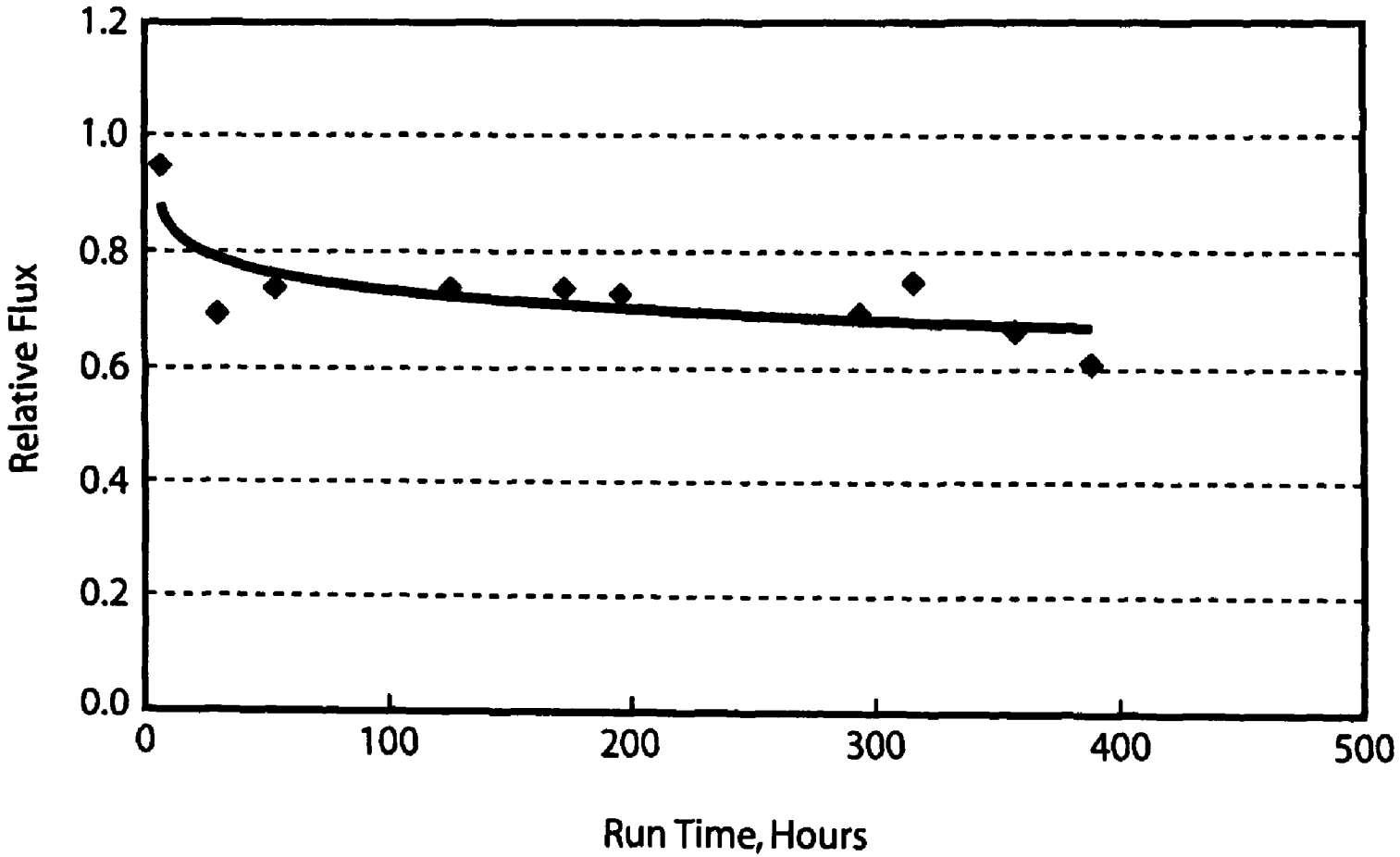
FIG. 4 is a graph showing flux at different run times.
Figure 5:
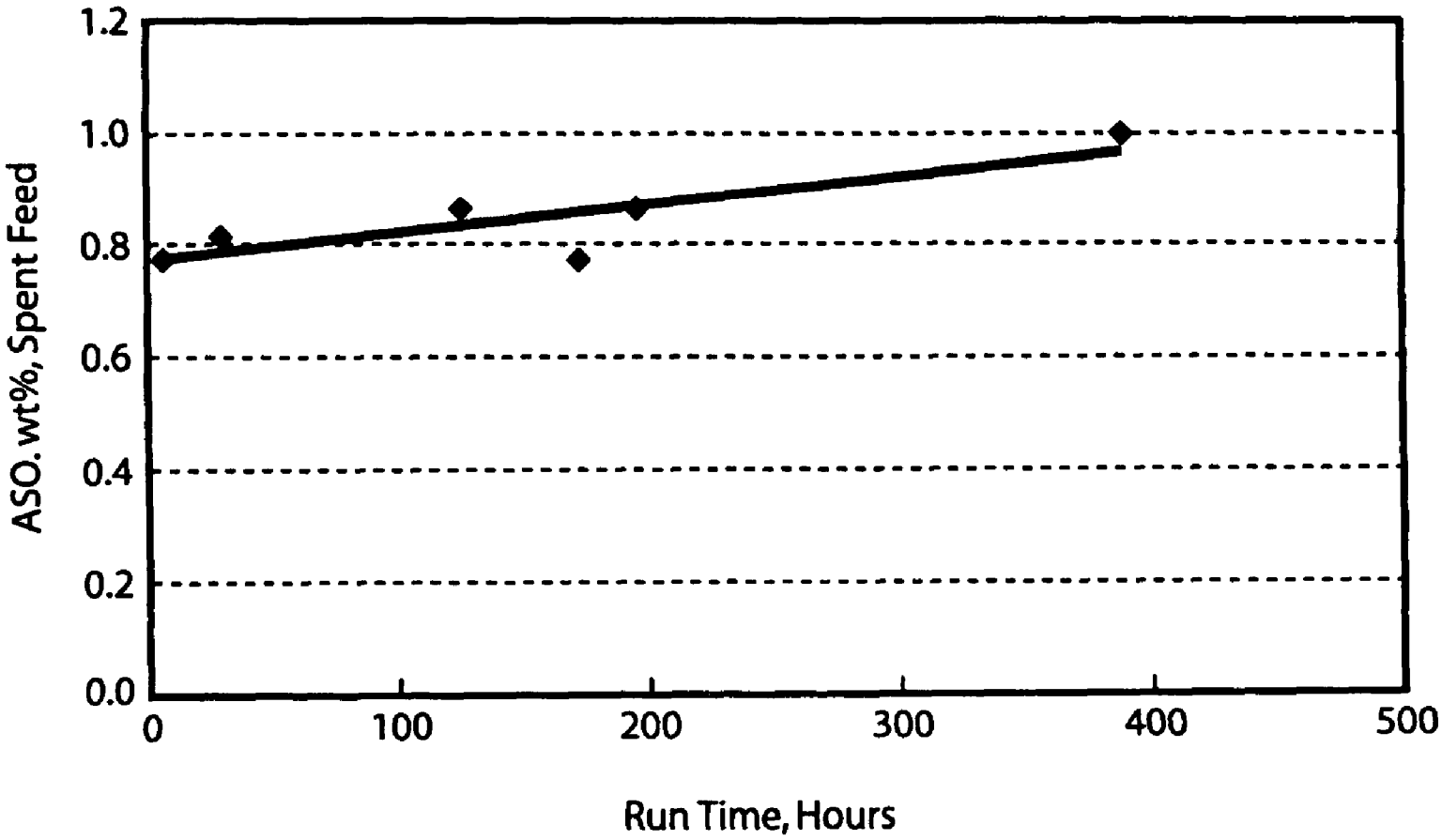
FIG. 5 is a graph showing acid soluble oil concentration in the feed at different run times.
Figure 6:
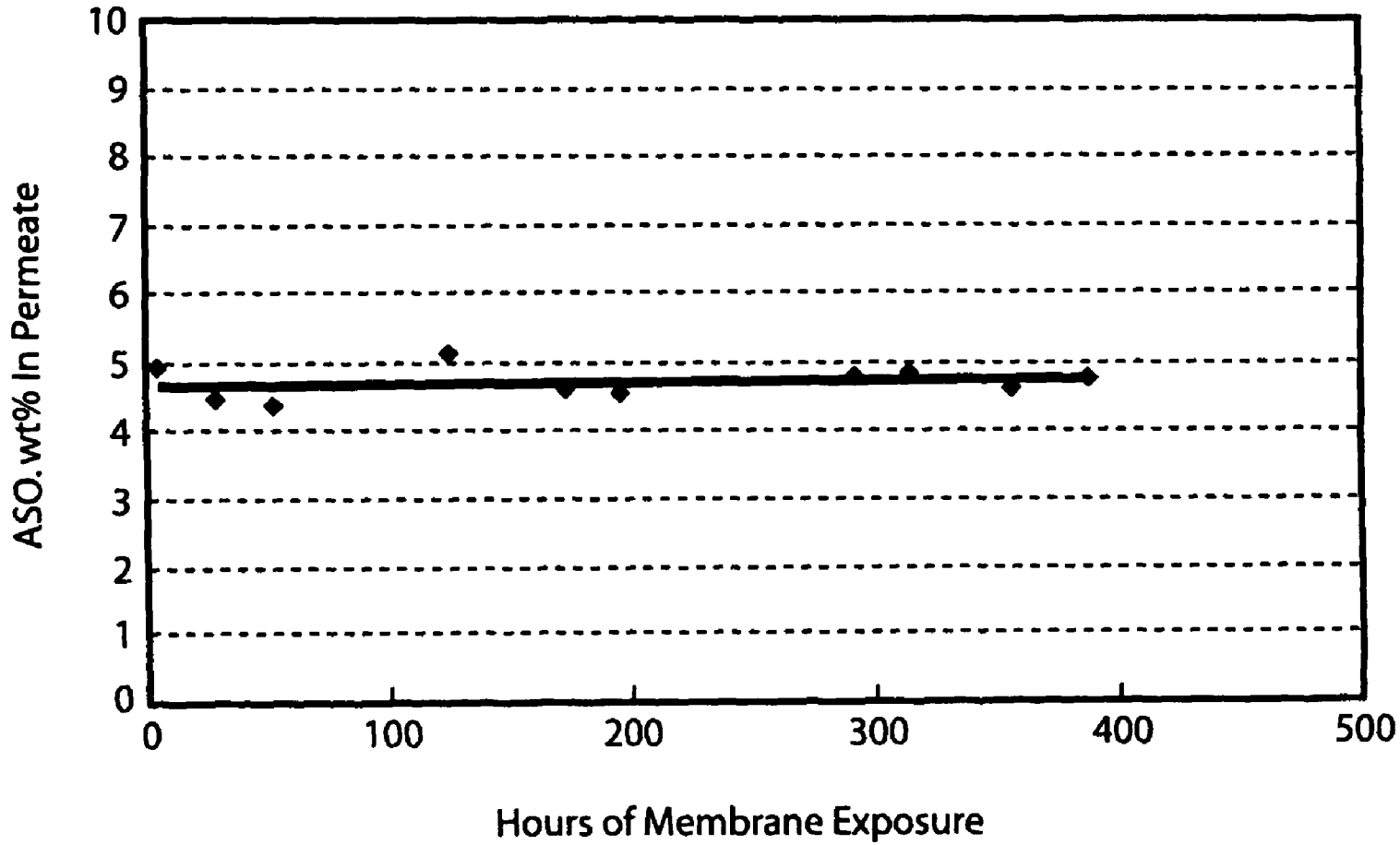
FIG. 6 is a graph showing acid soluble oil concentration in the permeate at different run times.

PVA membrane once exposed to sulfuric acid converts to poly (vinyl sulfate) [PVS] material. The PVS membrane performance is presented in FIGS. 4, 5 and 6. FIG. 4 presents the membrane flux with time. FIGS. 5 and 6 present ASO concentrations in feed and permeate streams, respectively. Permeate stream had about 50% lower concentration of ASO indicating that the membrane is rejecting 50% of the ASO. These characteristics of a membrane can be used for evaluating membranes for sulfuric acid regeneration.

The invention claimed is:

1. A process for the acid extraction of a hydrocarbon feed containing nitrogen contaminants which comprises: contacting the hydrocarbon feed with a mineral acid in an extraction zone to produce an acid treated hydrocarbon mixture, conducting the acid treated hydrocarbon mixture to a separation zone and separating the acid treated hydrocarbon mixture into a nitrogen lean hydrocarbon and a nitrogen rich hydrocarbon/acid mixture, conducting the nitrogen rich hydrocarbon/acid mixture to a first compartment of a membrane-containing unit, said unit further comprising a membrane and a second compartment, and selectively permeating the nitrogen rich hydrocarbon/acid mixture through the membrane into a hydrocarbon lean acid permeate in the second compartment and a hydrocarbon rich acid retentate in the first compartment.

2. The process of claim 1 wherein the mineral acid is sulfuric acid.

3. The process of any preceding claim wherein the extraction zone is a fiber film contactor.

4. The process of any preceding claim wherein the separation zone is a settler.

5. The process of any preceding claim wherein the settler includes a coalescing media.

6. The process of any preceding claim wherein the membrane comprises a perfluorinated ionomer membrane.

7. The process of any preceding claim wherein the perfluorinated ionomer membrane contains active anionic groups.

8. The process of any preceding claim wherein the perfluorinated ionomer membrane is a copolymer of perfluoroethylene and perfluorovinylether.

9. The process of any preceding claim wherein the membranes are made of at least one of polyvinyl alcohol, polyvinyl sulfate and oxoanion modified polyvinyl alcohol.

10. The process of any preceding claim wherein the oxoanion is phosphate, arsenate, selenate, tellurate, nitrate or borate.

11. The process of any preceding claim wherein at least a portion of the hydrocarbon rich acid retentate is passed to the separation zone.

12. The process of any preceding claim wherein at least a portion of the hydrocarbon lean acid permeate is passed to the extraction zone.

13. The process of any preceding claim wherein the hydrocarbon lean acid permeate is passed to a second membrane containing unit.

14. The process of any preceding claim wherein at least a portion of the hydrocarbon rich acid retentate is regenerated.

* * * * *